United States Patent [19]

Maruyama et al.

[11] 4,319,231

[45] Mar. 9, 1982

[54] FIRE SENSING SYSTEM PROTECTED FROM NOISE FACTORS

[75] Inventors: Masaki Maruyama; Kohei Nakamura, both of Machida, Japan

[73] Assignee: Hochiki Corporation, Tokyo, Japan

[21] Appl. No.: 69,842

[22] Filed: Aug. 27, 1979

[30] Foreign Application Priority Data

Aug. 26, 1978 [JP] Japan ..... 53/116219[U]
Nov. 27, 1978 [JP] Japan ..... 53/161798[U]

[51] Int. Cl.[3] ..... G08B 17/10

[52] U.S. Cl. ..... 340/587; 340/509; 340/584; 340/628

[58] Field of Search ..... 340/587, 509, 693, 593, 340/595, 628, 629, 630, 584

[56] References Cited

U.S. PATENT DOCUMENTS 3,909,814 9/1975 Eguchi ..... 340/629

FOREIGN PATENT DOCUMENTS 2745292 12/1979 Fed. Rep. of Germany ..... 340/509

*Primary Examiner*—Glen R. Swann, III
*Attorney, Agent, or Firm*—Oblon, Fisher, Spivak, McClelland & Maier

[57] ABSTRACT

Fire detection signals are produced with high reliability based upon a quantity smaller than a predetermined quantity from a fire sensing system which detects predetermined standard quantities of combustion products (or physical quantities) such as heat, smoke or light produced by a fire. The system includes a fire sensor connected in parallel with a first semiconductor switching element and a second semiconductor switching element contained in two independent power-supply circuits. The first power-supply circuit contains the first semiconductor switching element which detects a combustion quantity smaller than the standard quantities and which is rendered conductive upon receipt of an early output produced by the fire sensor. The first power supply circuit is connected in parallel with a second power-supply circuit containing the second semi-conductor switching element which detects the standard quantities and which is rendered conductive upon receipt of an alarm output produced by the fire sensor. A substantial delay time based upon a statistical time difference expected to exist from an early output corresponding to the initial stage of the occurrence of fire to the production of an alarm output corresponding to the decision that a fire exists is provided between the operations of the first semiconductor switching element and the second semiconductor switching element. Noise energy induced in the system is absorbed by the first semi-conductor switching element rendered conductive after the substantial delay time has passed, such that the second power-supply circuit including the second semiconductor switching element is maintained in a proper condition to control the production of the fire alarm.

3 Claims, 5 Drawing Figures

FIRE SENSING SYSTEM PROTECTED FROM NOISE FACTORS

BACKGROUND OF THE INVENTION

The present invention relates to an improved fire sensing system in which a first or a second semiconductor switching element which will be rendered conductive by the detection output from a fire sensor is connected to at least two power-supply circuits which actuate the fire sensors, and in which noise energy induced in the system is absorbed by the first semiconductor switching element relying upon a substantial time difference which provides a time interval for the operation of the first and the second semiconductor switching elements, so that the second semiconductor switching element or the power-supply circuit including the second semiconductor switching element is maintained in a proper condition.

A fire sensor capable of producing a plurality of detection outputs has been proposed in Japanese Utility Model Laid-Open No. 24284/78, consisting, as shown in FIG. 1 of the present application, of a switching element 4 which operates in synchronism with the operation of an oscillation circuit 1, a plurality of switching elements 5*a*, 5*b* and 5*c* for successively changing resistors $R_1$, $R_2$, $R_3$, $R_4$ and $R_5$ connected in series with the switching element 4 from a high sensitivity toward a low sensitivity, a fire detecting switching element 9 provided in a fire detection unit 6 which produces fire detection signals proportional to the smoke concentration produced by a fire, a scanning circuit 10 which is operated by the output of the switching element 9 to successively render the switching elements 5*a* to 5*c* conductive thereby changing the sensitivity, an alarm producing switching element 11 which is operated by the output of the fire detecting switching element 9 to short-circuit lines 2*a*, 2*b* so that the impedance therebetween is decreased, and a restoration circuit 12 which resets the scanning circuit 10 to the initial state when the output of the oscillation circuit 1 becomes out of agreement with the output of the fire detecting switching element 9.

In the fire sensor shown in FIG. 1, however, if noise or the like is generated, the scanning circuit employing a shift register is operated even when the alarming switching element 11 is not rendered conductive so that the switching elements 5*a* and 5*c* are operated causing the detection sensitivity to be changed. Therefore, the fire sensor shown in FIG. 1 is not practicable unless the scanning circuit 10 is powered by a separate power supply or is isolated by using a photo-coupler in the input/output signal stage of scanning circuit 10. Therefore, the circuitry of the existing fire sensor inevitably becomes complicated. Further, a fire sensor having a plurality of sensitivities is usually intended to be interlocked to facilities for preventing and exhausting smoke in addition to providing fire alarms. According to the conventional example illustrated in FIG. 1, a receiving unit is interlocked to other fire-preventing facilities subsequent to the fire alarm, responsive to the number of signals produced by the same fire detector. Hence, in case a plurality of fire sensors connected to the same circuit produce alarms, the receiving unit is not capable of discriminating at which sensitivity such alarms are produced. There has also been proposed a system utilising two or more detection outputs as illustrated in FIG. 2, by employing, in addition to a fire sensor for producing a fire alarm, a fire sensor which detects a combustion quantity to produce an output and by energizing safety facilities such as those for preventing and exhausting smoke relying on the output of the latter fire sensor which detects the combustion quantity. According to this system, a circuit $L_3$ is run from a given sensor, for example, from a sensor $S_2$ among sensors $S_1$, $S_2$, $S_3$, etc. connected to sensor circuits $L_1$, $L_2$ from a receiver R, thereby to supply an interlocked relay $B_1$ for the receiver R. A contact $b_1$ of the interlocked relay inserted in the circuits $L_4$, $L_5$ is closed to energize a response device Z for actuating equipment to prevent or exhaust smoke (to actuate the facilities for preventing and exhausting smoke) when the interlocked relay $B_1$ is energized by the operation of the sensor $S_2$. A relay $B_2$ is energized by a contact $b_3$ which will be closed when the operation is completed, such that the interlocked state can be confirmed by the illumination of display lamp. At the same time, a contact $a_1$ of a fire alarm relay $A_1$ of the receiving unit R is closed by the operation of the sensor $S_2$, whereby the sensor circuits $L_1$, $L_2$ are short-circuited to produce a fire alarm. There will be no problem if the sensor $S_2$ interlocked to other facilities is energized first. However, when another sensor, for example, a sensor $S_1$ having no relation to other facilities is energized first, the closure of the contact $a_1$ of the fire alarm relay $A_1$ causes the sensor circuits $L_1$, $L_2$ to be short-circuited so that the impedance is decreased. Consequently, the sensor $S_2$ interlocked to other facilities is not served with sufficient power-supply voltage, causing the system to be inoperative even when smoke has infiltrated into the system's sensors.

According to a further conventional example disclosed in U.S. Pat. No. 3,909,814, a plurality of semiconductor switching elements are connected to a power-supply circuit in parallel with each other, and fire sensors are connected in parallel with the switching elements to successively render them conductive responsive to increases in the combustion quantity. According to this embodiment in which many semiconductor switching elements for controlling different alarm signals are connected to the same power supply in parallel with each other, there is no way to specify a signal line which works to absorb noise energy upon the receipt of noise.

SUMMARY OF THE INVENTION

The object of the present invention is to provide an improved fire sensing system which detects a plurality of predetermined different quantities of combustion products such as heat, light, smoke and the like to produce two or more types of signals, wherein power-supply circuits are used in a number equal to the number of dissimilar signals defined by different but predetermined quantities of the combustion products. Semiconductor switching elements rendered conductive by the same type of signals are connected to the respective power-supply circuits. An operation interval which is substantially delayed in time is provided between each of the semiconductor switching elements which are rendered conductive by the detection signals of smaller and greater combustion quantities, whereby a power-supply circuit including a semiconductor switching element which is rendered conductive by the detection signals of smaller combustion quantities operates upon receipt of external noise, so that the noise energy is absorbed and other semiconductor switching elements are prevented from being abnormally rendered conductive.

Another object of the present invention is to provide a fire sensing system having improved reliability made up of an ideal combination of a power-supply circuit including semiconductor switching elements which will be rendered conductive by the detection signals of combustion quantities necessary for producing a fire alarm, and another power-supply circuit including semiconductor switching elements which will be rendered conductive by the detection signals of greater combustion quantities necessary for actuating fire preventing, fire-extinguishing and safety facilities, so that the safety facilities such as the fire-extinguishing facilities or the like are not actuated by external noise.

A further object of the present invention is to provide a highly reliable fire sensing system in which a signal for operating the first semiconductor switching element is connected to a power-supply circuit including the second semiconductor switching element which will be rendered conductive by a signal defined by a quantity greater than the combustion quantity which defines a signal for actuating the first semiconductor switching element after the first semiconductor switching element of the power-supply circuit which is rendered conductive upon the receipt of the external noise has been operated; and a fire sensing system in which an early signal and a subsequently occurring main signal are produced by the independent power-supply circuits so that output conditions of an output portion of the fire sensor is changed by the application of the early signal in order that a signal is produced to render the second semiconductor switching element conductive when the fire sensor having the output portion which has produced the signal to render the first semiconductor switching element conductive has detected a greater combustion quantity.

Still another object of the present invention is to provide a highly reliable fire sensing system in which signal circuits which produce and transmit signals of the same type among a plurality of fire detection signals produced by a fire sensor in a manner distinguisable from the signals of other types, serve as independent power-supply circuits; and a fire sensing system in which a plurality of DC batteries that serve as emergency power supplies for a plurality of signal circuits and which produce and transmit early signals, supply electric power to the fire sensors maintaining balance with respect to emergency batteries for signal circuits of subsequent signals, said first-mentioned emergency batteries being connected in parallel with the loads, i.e., being connected in parallel with the fire sensors via diodes having polarities that are opposite with respect to the diodes of the other signal circuits.

According to the fire sensing system of the present invention, a main signal circuit for producing and transmitting main signals is made up of independent signal circuits allotted to each type of signal so that the system is protected from the external noise, and the independent signal circuits are provided with independent power supplies to feature a simplified circuit network maintaining very high reliability. The signals can be allotted to each of the signal circuits having their own power supplies as mentioned below.

(1) A small quantity of heat produced by the ordinary use of fire, which is not a house or building fire, is detected by the fire sensor, and the detected signal is called the early signal. In a strong room where fire is not usually used, the early signals may be produced in a plurality of numbers relying upon further smaller combustion quantities.

(2) The fire sensor detects a quantity of combustion in excess of the ordinary use of fire. The detected signal is called main signal or fire signal.

(3) In order to provide time for people to evacuate, a further increased combustion quantity is detected by the fire sensor after the fire signal has been produced. The detected signal is called the facility operation signal. The number of signals may further be increased, as required, by dividing the facility operation signal.

There is no practical problem even when external noise energy is confused with the early signal hereafter referred to as signal (1). However, the problem gets worse when the external noise is confused with the facility operation signal hereafter referred to as signal (3), because fire extinguishing liquids or chemicals may be injected even when no real fire has broken out. When the external noise is confused with the fire signal hereafter referred to as the signal (2), the situation can be permitted when the facility operation signal (3) is not been "produced" with considerable certainty. However, this can be usually avoided. Thus, three types of signals should be provided for the fire sensing system. If three signal circuits are provided, it is possible to provide simply constructed and highly reliable receiving facilities without employing conventional discrimination circuits. After having recognized that a simply constructed circuit can be provided without using complicated circuit or electrical means for discriminating the signals, the inventors of the present invention have studied a means which maintains high reliability even against the noise. In order for the system not to lose reliability even when the usually inert signal circuits are activated by the external noise, the circuits should not be the signal circuit of the abovementioned facility operation signal (3). When the circuit is activated, the noise energy is absorbed, and the signal circuit (3) is protected from the noise energy. In order to activate the circuits other than the circuit (3) which should not be erroneously activated, it is required to provide means which does not change the voltage applied to the fire sensors which must always be served with normal voltage. This means is realized by providing a power supply for each of the signal circuits. As a result, the power supplies for each of the signal circuits connected in parallel with the fire sensors are connected through diodes so that the polarities of the diodes are reversed with respect to the diodes of the other signal circuits, whereby the power-supply voltages are balanced with respect to each other to energize the fire sensors, thus presenting superior results.

When two signal circuits are to be employed, the abovementioned circuit (1) or (2) should be selected as a circuit to absorb the noise energy, and the abovementioned circuit (2) or (3) should be used as a main signal circuit.

The time in which the noise energy affects the system usually ranges in the order of microseconds. Therefore, if a delay time on the order of milliseconds to seconds is provided between the signal (1) and the signal (2), or between the signal (2) and the signal (3), the latter main signal circuit can be protected even if the former circuit is activated. When the signal (1) which is confused with the noise energy is fed back to the electric output portion of the fire sensors so that the signal (1) is converted into a quantity greater than the combustion quantity of the detection output condition of the fire sensor, the time which is usually expected for the increase in the combustion quantity becomes greater than the aforementioned time. Therefore, there is no need for specifically employing a delay time.

Further, the early signal in contrast to the main signal is produced by the external noise or by the ordinarily used fire which is not a house or building fire. Therefore, the reliability can be further enhanced if an automatic reset function is included in the circuit for producing early signals. In this case, the fire sensors in a high-sensitivity state pick up noises, or frequently produce the early signals to the system by picking up ordinarily used fire or slightly dangerously used fire, so that the proper high-sensitivity function of the system can be continued.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
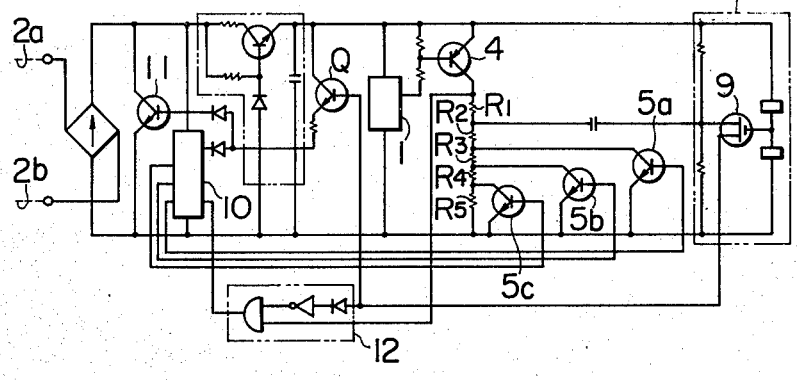
FIG. 1 PRIOR ART
FIG. 1 is a circuit diagram showing a conventional fire sensor employing a scanning circuit consisting of shift registers to change the sensitivity.
Figure 2:
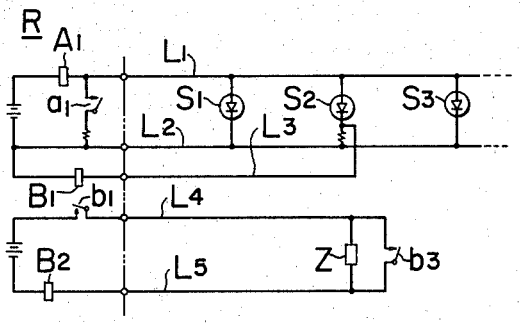
FIG. 2 PRIOR ART
FIG. 2 is a circuit diagram showing a conventional example of a fire alarming system interlocked to a conventional facility for preventing and exhausting the smoke.
Figure 3:
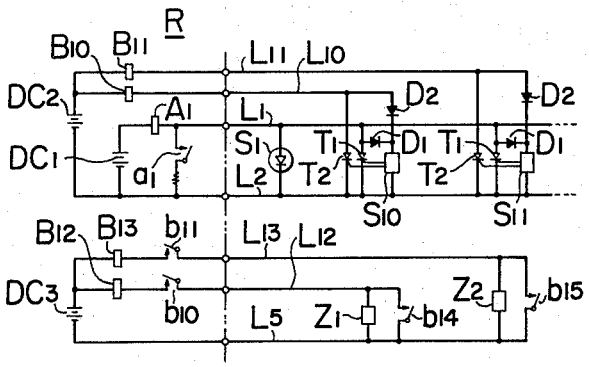
FIG. 3 is a circuit diagram showing a fire alarming system according to an embodiment of the present invention.

Referring now to the drawings, wherein like reference numerals designate identical or corresponding parts throughout the several views, and more particularly to FIG. 3 thereof, a receiving unit R is provided with a relay $A_1$ having a contact $a_1$ for producing a fire alarm as in a conventional system. A sensor $S_1$ for producing the fire alarm is connected to sensor circuits $L_1$, $L_2$ which supply electric power from a d-c power supply $DC_1$. Smoke sensors $S_{10}$, $S_{11}$, which work to operate facilities, have two detection sensitivities for producing fire signals and signals for preventing and exhausting smoke. $S_{10}$ and $S_{11}$ individually produce detection signals when a smoke concentration infiltrated into the sensors has reached a detection sensitivity. The smoke sensors $S_{10}$, $S_{11}$ are each provided with two thyristers $T_1$, $T_2$ which work as switching elements and which will be rendered conductive by the detection signals from the smoke sensors $S_{10}$, $S_{11}$. One thyristor $T_1$ is connected between the sensor circuits $L_1$, $L_2$ and is served with a voltage from the d-c power supply $DC_1$, and another thyristor $T_2$ is connected between circuits $L_{10}$ and $L_2$ or $L_{11}$ and $L_2$ connected to another d-c power supply $DC_2$.

The electric power is supplied to the smoke sensors $S_{10}$, $S_{11}$ through the circuits $L_1$ and $L_{10}$ or $L_{11}$. Diodes $D_1$, $D_2$ are connected between the circuits to prevent the electric current from flowing in the reverse direction. Further, the circuits $L_{10}$, $L_{11}$ contain interlocking relays $B_{10}$, $B_{11}$ which will be energized when the thyristors $T_1$, $T_2$ are rendered conductive. Relay contacts $b_{10}$, $b_{11}$ of the relays $B_{10}$, $B_{11}$ are inserted in circuits $L_{12}$, $L_{13}$ connected to another d-c power supply $DC_3$. Relays $B_{12}$, $B_{13}$ for removing and exhausting smoke, inserted in the circuits $L_{12}$ and $L_{13}$, are energized by the closure of the contacts $b_{10}$, $b_{11}$. To the terminals of the circuits $L_{12}$, $L_{13}$ are connected response devices $Z_1$, $Z_2$, as well as contacts $b_{14}$, $b_{15}$ which will be closed when the operations are completed by the response devices $Z_1$, $Z_2$.

The circuits operate as discussed below. The detection sensitivities of the interlocking smoke sensors $S_{10}$, $S_{11}$ can be suitably determined depending upon the requirements. To simplify the description, it is assumed here that the fire detecting sensitivity of the smoke sensor $S_{10}$ has been set to a value more sensitive than the sensitivity for preventing and exhausting smoke, i.e., the sensitivity of the smoke sensor $S_{10}$ has been set to a level for detecting a small combustion quantity. If now smoke has infiltrated into the smoke sensor $S_{10}$ and reached the fire detection sensitivity, the thyristor $T_1$ is first rendered conductive by the detection signal. The fire alarming relay $A_1$ is energized by the thyristor $T_1$ which is rendered conductive, whereby the contact $a_1$ is switched to a closed state. Therefore, the circuits $L_1$, $L_2$ are essentially short-circuited, such that a fire alarm is produced. In this case, the voltage across the circuits $L_1$ and $L_2$ is decreased due to the thyristor $T_1$ becoming conductive, while the smoke sensor $S_{10}$ is served with electric power from the d-c power supply $DC_2$ through the circuit $L_{10}$, and the flow of current from the circuit $L_{10}$ to the circuit $L_1$ is prevented by the diode $D_1$. Therefore, the power supply voltage is not varied even when the thyristor $T_1$ is rendered conductive. Then, as the concentration of smoke which has infiltrated into the sensor reaches the sensitivity for preventing and exhausting smoke, the sensor produces a detection signal to render the thyristor $T_2$ conductive, so that the interlocking relay $B_{10}$ of the circuit $L_{10}$ is energized. The contact $b_{10}$ is closed by the interlocking relay $B_{10}$ which is energized, and the contact $b_{14}$ is closed when the operation of the response device $Z_1$ is completed. The relay $B_{12}$ is then energized so that the facilities for preventing and exhausting smoke are operated and so that the operation can be confirmed.

Even when the smoke sensor $S_1$, which has no relation to the interlocked operation, has produced an alarm at first to short-circuit the circuits $L_1$, $L_2$ so that they acquire a small impedance, the interlocking smoke sensors $S_{10}$, $S_{11}$ are served with electric power from another d-c power supply $DC_2$ through the circuits $L_{10}$, $L_{11}$, and are not at all affected by the alarm produced by the smoke sensor $S_1$ which is specially designed to produce a fire alarm. Further, even when the interlocking smoke sensors $S_{10}$, $S_{11}$ are so set that their sensitivities for preventing and exhausting smoke are more sensitive than the sensitivity for detecting fire, the fire alarm can be reliably produced even after the smoke sensors have been interlocked to the facilities for preventing and exhausting smoke. The facilities for preventing and exhausting smoke of the abovementioned embodiment may be equipped with facilities for evacuating people or may be replaced by it.

Figure 4:
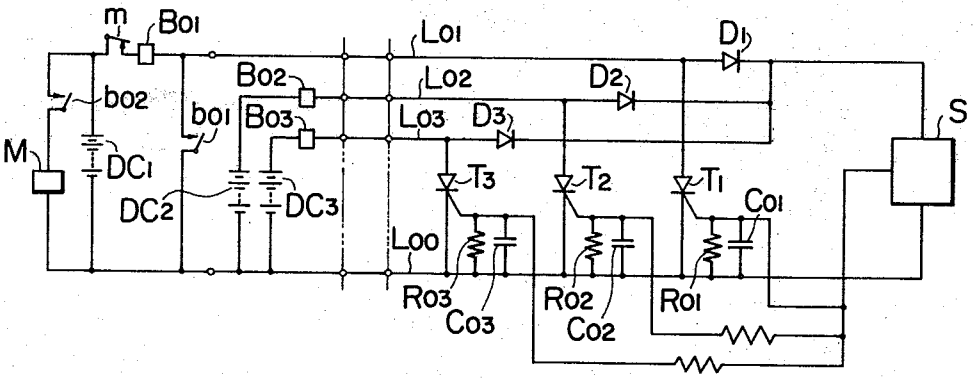
FIG. 4 is a circuit diagram showing another embodiment of the present invention.

FIG. 4 shows a circuit consisting of three independent signal circuits $L_{01}$, $L_{02}$ and $L_{03}$ which utilize statistical times required for an increase of the combustion quantity to produce three types of detection signals based upon two to three delay times. The external noise induced on a photoelectric fire sensor being caused by a strobe light will last for about one-thousandth of a second, and a discharge noise at 10 KV by a charging capacitor of 250 pF lasts for a period of about several microseconds. Therefore, if the circuit is so designed as to cope with a noise duration time of 10 milliseconds to 100 milliseconds, most of the external noise energy can be absorbed by the signal circuit $L_{01}$. Delay circuits $C_{01}$ and $R_{01}$ connected to the trigger terminal of a semiconductor switching element $T_1$ connected between the circuits $L_{01}$ and $L_{00}$ are determined by taking into consideration the noise duration period. The trigger delay time $C_{02}$ and $R_{02}$ of a switching element $T_2$ is determined based upon the moment at which a combustion quantity which causes the sensor S to produce a signal for triggering the switching element $T_1$ has entered into the sensor S, i.e., determined based upon the statistical time (installation places, etc.) from the initial stage of fire to a time at which the combustion quantity is sufficiently great to render a decision that a fire has broken out. The trigger delay time $C_{03}$ and $R_{03}$ of the switching element $T_3$ is determined based upon the statistically calculated time lasting from the moment the fire alarm is produced until the moment the fire extinguishing agent is sprayed and people are allowed to evacuate. The trigger delay times of the switches $T_2$ and $T_3$ are usually selected to last for several seconds to several minutes in contrast with very short duration of the noise energy mentioned above, and hence the circuit is not activated by the noise. The three signal circuits $L_{01}$, $L_{02}$ and $L_{03}$ are provided with independent d-c power supplies $DC_1$, $DC_2$ and $DC_3$, and the electric power is fed in the forward direction to the first sensor S through diodes $D_1$, $D_2$ and $D_3$. Further, the circuits are provided with relays $B_{01}$, $B_{02}$ and $B_{03}$ for detecting the signals of the signal circuits. The relays produce an early fire alarm, a fire alarm, and further work to operate the fire-preventing facilities. The signal circuit $L_{01}$ which works to absorb the noise energy is equipped with a moving contact $b_{01}$ which is self-retained by the relay $B_{01}$ and a moving contact $b_{02}$ for operating a timer M. An open contact m of a timer M is also provided between the power supply $DC_1$ and the relay $B_{01}$. After the noise energy has activated the circuit $L_{01}$, the timer M starts to operate; after a predetermined period of time (preferably several seconds to several tens of minutes) has passed, the circuit is opened to reset the system. Thus, the circuit $L_{01}$ offers a function to always judge whether the system is in normal condition.

Figure 5:
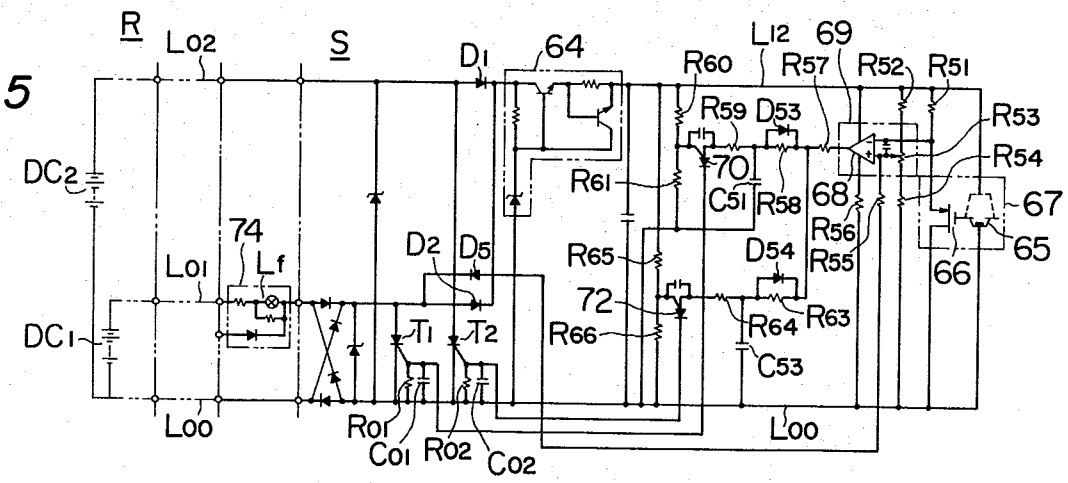
FIG. 5 is a circuit diagram showing a fire sensing system employing a circuit which changes the detection output conditions such that a detection signal is produced when greater combustion quantities are fed to the fire sensor.

FIG. 5 illustrates fire sensors having a plurality of detection sensitivities and a fire sensing system employing the fire sensors which separately send, for each of the detection sensitivities, fire signals to a plurality of wires which are drawn from the receiving unit and which send signals and supply electric power. From the receiving unit R are drawn wires $L_{01}$, $L_{02}$ and a common wire $L_{00}$ which work to send signals and electric power. The wires $L_{01}$ and $L_{02}$ are provided with independent d-c power supplies $DC_1$ and $DC_2$. The lines $L_{01}$, $L_{02}$ for feeding signals and electric power are connected to a common feeder line $L_{12}$ in the sensor via diodes $D_1$, $D_2$ for preventing a reversal of flow. The common feeder line $L_{12}$ is provided with a constant-voltage circuit 64. When the line $L_{01}$ for feeding signals and electric power is short-circuited to acquire a low impedance due to the alarm produced by the sensor at a given sensitivity, the diodes $D_1$, $D_2$ work to supply the electric power to the common feeder line $L_{12}$ through the wire $L_{02}$ which feeds signals and electric power. In this case, the diode $D_2$ works to prevent the flow of electric current from the wire $L_{02}$ to the wire $L_{01}$.

Between the common feeder wire $L_{12}$ and the common wire $L_{00}$ are provided a smoke detecting unit 65 of which the electrode impedance changes by the infiltration of smoke produced by fire, a fire detecting unit 67 consisting of a field effect transistor 66 which changes impedance in proportion to the smoke concentration to produce a fire detection signal, and a comparator 69 consisting of a voltage comparator 68. The voltage comparator 68 has a positive input terminal impressed with a first reference voltage determined by resistors $R_{52}$, $R_{53}$, $R_{54}$, and a negative input terminal connected to the source of the field effect transistor 66. The first reference voltage determined by the resistors $R_{52}$, $R_{53}$ and $R_{54}$ is used to set the initial sensitivity of the sensor. The circuit has been so designed that under ordinary conditions, the signal potential from the fire detector circuit 67 is greater than the reference potential. Therefore, the output of the voltage comparator 68 is maintained at a low level. The output of the voltage comparator 68 is-fed to the anode of a programmable unijunction transistor (hereinafter referred to as PUT) 70 via an integrating circuit consisting of a capacitor $C_{51}$ and a resistor $R_{58}$. A reference voltage determined by resistors $R_{60}$, $R_{61}$ is applied to the gate of the PUT 70. On the other hand, the output of the voltage comparator 68 is fed to the anode of a PUT 72 via an integrating circuit consisting of a capacitor $C_{53}$ and a resistor $R_{63}$. A reference voltage determined by resistors $R_{65}$, $R_{66}$ is applied to the gate terminal of the PUT 72. The time constant of the integrating circuit provided on the input side of the PUT 70 has been selected to be smaller than the time constant of the integrating circuit of the input side of the PUT 72. Hence, the PUT 70 is first rendered conductive by the output of the voltage comparator 68.

The cathode of the PUT 70 is connected to the gate of a thyristor $T_1$ via a gate circuit consisting of a resistor $R_{01}$ and a capacitor $C_{01}$, while the thyristor $T_1$ is connected between the wire $L_{01}$ for feeding signals and electric power and the common wire $L_{00}$, thereby to constitute a first switching element. Further, the cathode of the PUT 72 is connected to the gate of a thyristor $T_2$ via a gate circuit consisting of a resistor $R_{02}$ and a capacitor $C_{02}$, while the thyristor $T_2$ is connected between the wire $L_{02}$ for feeding signals and electric power and the common wire $L_{00}$, thereby to constitute a second switching element. The wire $L_{01}$ which is short-circuited to acquire a small impedance by of the thyristor $T_1$ becoming turned on is connected to a positive input terminal of the voltage comparator 68 via diode $D_5$ and a resistor $R_{55}$, such that the reference potential of the voltage comparator 68 is changed by the thyristor $T_1$ becoming turned on. The wire $L_{01}$ for feeding signals and electric power has been equipped with an alarm display portion 74 which turns on an alarm display lamp $L_f$.

Under an ordinary monitoring condition, the reference voltage applied to the positive input terminal of the voltage comparator 68 has been set to be smaller than a high voltage applied to the negative input terminal. Therefore, the output of the voltage comparator 68 has been placed at a low level. Under this condition, if smoke infiltrates into an outer chamber of the smoke detecting unit 65, the gate potential of the field effect transistor 66 is lowered, and the potential at the negative input terminal of the voltage comparator 68 is decreased. If the potential at the negative input terminal becomes lower than the reference potential at the positive input terminal, the output of the voltage comparator 68 is reversed to acquire a high level. Capacitors $C_{51}$, $C_{53}$ are electrically charged by the high-level output of the voltage comparator 68 via resistors $R_{58}$ and $R_{63}$. Since the time constants of the integrating circuits on the input side of the PUT 70 and on the side of the PUT 72 are related such that $R_{58} \cdot C_{51} < R_{63} \cdot C_{53}$, the terminal voltage of the capacitor $C_{51}$, i.e., the anode potential of the PUT 70 becomes greater than the gate potential, such that the PUT 70 is first rendered conductive. As the PUT 70 is rendered conductive, a signal is given to the gate circuit consisting of the resistor $R_{01}$ and the capacitor $C_{01}$, whereby the thyristor $T_1$ is rendered conductive causing the wire $L_{01}$ for feeding signals and electric power and the common wire $L_{00}$ to be short-circuited to aquire a small impedance, such that an alarm signal produced with a high detection sensitivity is given to the receiving unit R. The alarm produced by the thyristor $T_1$ becoming turned on serves as a fire alarm; the receiving unit R actuates the fire alarm display unit. At the same time, the alarm display lamp $L_f$ of the alarm display circuit 74 is turned on by the alarm current. The potential of the wire $L_{01}$ for feeding signals and electric power is decreased by the thyristor $T_1$ becoming turned on making it difficult to feed power to the sensor. Therefore, the electric power is supplied through the wire $L_{02}$ for feeding signals and electric power. Here, the diode $D_2$ prevents current flow from the wire $L_{02}$ to the wire $L_{01}$. Hence, power is supplied to the sensor through the common feeder wire $L_{12}$.

On the other hand, after the thyristor $T_1$ is rendered conductive, the potential at the anode terminal becomes nearly zero volt. Hence, the positive input terminal of the voltage comparator 68 is connected to the common wire $L_{00}$ via the resistor $R_{55}$ and the thyristor $T_1$. The detection sensitivity is decreased by the decrease in the reference potential of the voltage comparator 68. Then, the potential at the negative input terminal of the voltage comparator 68 again becomes higher than the reference potential, causing the output of the voltage comparator 68 to acquire the low level. As the output of the voltage comparator 68 acquires the low level, the once charged capacitors $C_{51}$ and $C_{53}$ are immediately discharged through diodes $D_{53}$, $D_{54}$. The PUT 70 which was once rendered conductive is then rendered nonconductive, and the gate current to the thyristor $T_1$ is interrupted. However, the thyristor $T_1$ which was once rendered conductive is maintained in a conductive state.

Under this condition, if more concentrated smoke enters into the outer chamber of the smoke detecting unit 65, the source potential of the field effect transistor 66 is decreased, i.e., the potential at the negative input terminal of the voltage comparator 68 is decreased. When the potential is decreased below the changed reference potential, the voltage comparator 68 is inverted again so that the output is inverted to acquire a high level. Then, the PUT 70 is rendered conductive by the electrically charged capacitor $C_{51}$. The alarming state, however, is not changed since the thyristor $T_1$ has already been rendered conductive. Then, as the anode potential of the PUT 72 exceeds the gate potential and reaches a predetermined value owing to the electric charge stored in the capacitor $C_{53}$, the PUT 72 is rendered conductive to feed a signal to the gate circuit consisting of the resistor $R_{02}$ and the capacitor $C_{02}$, whereby the thyristor $T_2$ is rendered conductive causing the wire $L_{02}$ for feeding signals and electric power and the common wire $L_{00}$ to be short-circuited to acquire a small impedance. Consequently, the alarm signal after the sensitivity has been changed is fed to the receiving unit R via the wire $L_{02}$ for feeding signals and electric power. Responsive to the alarm signal fed through the wire $L_{02}$, the receiving unit R actuates fire-preventing facilities such as equipment for preventing and exhausting smoke.

Although this embodiment has dealt with the case in which the detection sensitivity is changed in two stages, it is of course possible to change the sensitivity over any desired number of stages by increasing the wires for feeding signals and electric power. It is further possible to separately control different facilities utilizing the alarm signals produced at each of the changed sensitivities. It is further possible to provide a plurality of fire sensors for the same circuit from the receiving unit together with fire sensors (double-circuit type) designed for exclusively dealing with fire alarms. Likewise, it is possible to separately control different facilities for each of the sensors. An existing three-wire-type receiving unit and its circuit may be used in combination with the fire sensor of the present invention. Therefore, by simply replacing the fire sensor with that of the present invention, it is possible to easily realize a sensing system having different detection sensitivities, which works by being interlocked to various firepreventing facilities in addition to producing a fire alarm.

Further, according to the embodiment shown in FIG. 5, the integrating circuit consisting of the resistor $R_{58}$ and the capacitor $C_{51}$ which first renders the thyristor $T_1$ conductive being triggered by the PUT 70, also serves as a noise filter to prevent erroneous operation of the PUT even when noise is introduced. Accordingly, even when smoke such as that of tobacco has temporarily infiltrated into the smoke detecting unit 65, or even when the voltage comparator 68 is temporatily operated by ripples in the power-supply voltage, the PUT 70 is not rendered conductive. Consequently, an erroneous alarm is not produced, making it possible to reliably detect the occurrence of a fire.

Obviously, numerous modifications and variations of the present invention are possible in light of the above teachings. It is therefore to be understood that within the scope of the appended claims, the invention may be practiced otherwise as specifically described herein.

What is claimed as new and desired to be secured by Letters Patent of the United States is:

1. A fire sensing system comprising:

a fire sensor having a pair of load terminals and a pair of output terminals, said fire sensor being so constructed as to detect a predetermined combustion quantity relying upon a voltage applied to said load terminals and to produce a signal from said output terminals;

a first d-c power supply and a second d-c power supply which are coupled in parallel with said pair of load terminals of said fire sensor;

a first diode coupled between said first d-c power supply and said load terminals of said fire sensor and a second diode coupled between said second d-c power supply and said load terminals of said fire sensor such that the voltage of said first and second d-c power supplies are fed independently to said load terminals of said fire sensor;

a first signal circuit consisting of a first semiconductor switching element which is connected between an anode terminal and a cathode terminal of said first d-c power supply, and having a trigger terminal which is coupled to said output terminals of said fire sensor;

a second signal circuit consisting of a second semiconductor switching element which is connected between an anode terminal and a cathode terminal of said second d-c power supply, and having a trigger terminal which is coupled to said output terminals of said fire sensor;

a first delay means provided between the trigger terminal of said first signal circuit and said output terminals of said fire sensor to delay the trigger signals; and a second delay circuit provided between the trigger terminal of said second signal circuit and said output terminals of said fire sensor to delay the trigger signals by a time which is longer than the delay time of said first delay means;

whereby external noise energy causes said first signal circuit to operate, while said second signal circuit is stably maintained without being affected by the external noise.

2. A fire sensing system as recited in claim 1, which further comprises:

a plurality of relays, a first relay of said plurality of relays being coupled between said first d-c power supply and said first semiconductor switching element, said first relay responding to an increased current signal which flows from said first d-c power supply when said first semiconductor switching element is rendered conductive, a second relay of said plurality of relays being coupled between said second d-c power supply and said second semiconductor switching element, said second relay responding to an increased current signal which flows from said second d-c power supply when said second semiconductor switching element is rendered conductive; and safety means selected from the group consisting of fire alarming means, fire preventing means, and fire extinguishing means, said safety means being operated by said plurality of relays.

3. A fire sensing system as recited in claim 1, which further comprises:

variable sensitivity amplifier means coupled between said output terminals of said fire sensor and said trigger terminals of said first and second semiconductor switching elements, for supplying a first trigger signal to said trigger terminal of said first semiconductor switching element when a first signal having a first voltage level continuously appears at said output terminals for a first predetermined time period, and for supplying a second trigger signal to said trigger terminal of said second semiconductor switching element when, subsequent to said first trigger signal, a second signal having a second voltage level continuously appears at said output terminals for a second predetermined time period.

* * * * *